US008893359B2

(12) United States Patent
Brenk et al.

(10) Patent No.: US 8,893,359 B2
(45) Date of Patent: Nov. 25, 2014

(54) YARN SLUICE FOR SEALING A PRESSURIZED YARN TREATING CHAMBER

(75) Inventors: Siegfried Brenk, Krefeld (DE); Wilfried Rütten, Wegberg (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 861 days.

(21) Appl. No.: 13/110,316

(22) Filed: May 18, 2011

(65) Prior Publication Data

US 2011/0283748 A1 Nov. 24, 2011

(30) Foreign Application Priority Data

May 20, 2010 (DE) ..... 10 2010 022 211

(51) Int. Cl.
*D06B 3/04* (2006.01)
*D02J 13/00* (2006.01)
*D06B 23/18* (2006.01)

(52) U.S. Cl.
CPC ..... *D06B 23/18* (2013.01); *D02J 13/001* (2013.01); *D02J 13/006* (2013.01); *D06B 3/045* (2013.01)
USPC ..... 28/219; 28/220; 28/281; 68/5 E

(58) Field of Classification Search
CPC ..... D06B 3/04; D06B 3/045; D06B 3/06; D06B 23/18; D02J 13/001; D02J 13/006; D01H 13/30; D01H 13/306
USPC ..... 28/219, 220, 271, 272, 274, 281, 273, 28/282, 283; 68/5 D, 5 E, 5 C; 57/282, 309; 34/242, 629, 634, 636, 573, 639
See application file for complete search history.

(56) References Cited

U.S. PATENT DOCUMENTS

| | | | | |
|---|---|---|---|---|
| 2,708,843 | A * | 5/1955 | Gibson et al. | 68/5 E |
| 2,974,512 | A | 3/1961 | Carter | |
| 3,563,064 | A | 2/1971 | Yazawa | |
| 4,609,344 | A | 9/1986 | Runkel et al. | |
| 4,754,619 | A * | 7/1988 | Keith | 68/5 E |
| 5,287,606 | A * | 2/1994 | Ruef | 28/219 |
| 5,581,909 | A | 12/1996 | Ueda et al. | |
| 7,356,984 | B2 * | 4/2008 | Brenk | 57/295 |
| 7,997,055 | B2 * | 8/2011 | Brenk | 57/282 |
| 2005/0102764 | A1 * | 5/2005 | Brenk | 8/149.3 |

FOREIGN PATENT DOCUMENTS

| | | | |
|---|---|---|---|
| DE | 10348278 A1 * | 5/2005 | |
| EP | 1348785 A1 * | 10/2003 | D02J 13/00 |

* cited by examiner

*Primary Examiner* — Amy Vanatta
(74) *Attorney, Agent, or Firm* — Nelson Mullins Riley & Scarborough LLP

(57) ABSTRACT

A yarn sluice for sealing a pressurized yarn treating chamber in which a traveling yarn is thermally treated, comprises yarn guide elements in the region of a yarn inlet and outlet openings of the treating chamber forming a yarn guide channel sealed by the traveling yarn during operation. At least one of the guide elements is positionable for adaptation to the mean thickness of the traveling yarn in various predetermined positions. Means is provided for temporary adaptation of the yarn guide channel to yarn defects. At least one of the guide elements (26, 27) is steplessly adjustably mounted for adaption to the mean thickness of the traveling yarn (14). A sealing element (28), which can be placed on the first and the second yarn guide element (26, 27), extends along the yarn guide channel (25), for closing it and for reacting resiliently to defects in the traveling yarn (14).

10 Claims, 7 Drawing Sheets

YARN SLUICE FOR SEALING A PRESSURIZED YARN TREATING CHAMBER

CROSS REFERENCE TO RELATED APPLICATIONS

This application claims the benefit of German patent application DE 10 2010 022 211.9, filed May 20, 2010, herein incorporated by reference.

FIELD OF THE INVENTION

The invention relates to a yarn sluice for sealing a yarn treating chamber under excess pressure.

BACKGROUND OF THE INVENTION

It is known to subject yarns, for example after twisting or after cabling, to a thermal treatment and to thus achieve an improvement in the yarn quality. A thermal treatment of this type stabilizes the state of the yarns after the twisting or cabling and frees the yarns from inner torsional forces. Moreover, a thermal treatment of this type leads to a shrink bulking of the yarns, which brings about an increase in the volume of the yarn.

Various methods and mechanisms for the thermal treatment of yarns are described in the patent literature. It has been known, for a long time in this connection, for example, to send yarn wound on bobbins or cops in batches for thermal treatment into steam systems, so-called autoclaves and to thus simultaneously set a large number of bobbins or cops. These known setting devices, however, have the drawback that they require a relatively large amount of space and are also comparatively expensive to acquire. Moreover, qualitative losses of the yarn treated can often not be avoided in these setting devices.

Furthermore, yarn treating devices are known, which are arranged directly in the region of the workstations of twisting machines and with which setting can be carried out on the traveling yarn. There has been success in making the setting process of yarns more economical and efficient using yarn treating devices of this type described, for example, in European Patent Publication EP 1 348 785 A1 or in German Patent Publication DE 103 48 278 A1.

The known devices generally in each case have a yarn treating chamber, into which a gaseous or steam-like treating medium under pressure is blown, the subsequent process of cooling leading to the setting of the yarn. Yarn treating chambers of this type are also equipped with opposing yarn inlet and yarn outlet openings, in the region of which respective sealing devices are installed which seal the yarn treating chamber relative to the environment.

The yarn treating device described in European Patent Publication EP 1 348 785 A1, for example, has sealing devices, which have various rollers, with which pressure losses being produced when the yarn is running into or out of the yarn treating chamber are to be minimised. These sealing devices preferably have drivable outer sluice rollers and inner sealing rollers, which are in each case equipped with a resilient plastics material ring, into which the yarn is pressed when passing the sealing devices.

However, the comparatively wear-sensitive plastics material rings of the sealing rollers are disadvantageous in these sealing devices. The relatively short service life of the plastics material rings requires short service intervals, which has a very negative effect on the efficiency of the yarn treating device.

A yarn treating device is described in German Patent Publication DE 103 48 278 A1, in which the yarn treating chamber, in the region of its yarn inlet and yarn outlet opening, in each case has a yarn sluice with wear-resistant yarn guide elements. In a first embodiment of the yarn sluice, the latter is equipped with two identical, in each case semi-circular, yarn guide elements, which are pressed against one another by a spring element and have, in the region of a common centre longitudinal axis, recesses which form a yarn guide channel. The cross-section of the yarn channel is, in this case, precisely matched to the mean thickness of the yarn to be treated, in other words during operation, the yarn guide channel is sealed by the traveling yarn. When there is a yarn thickening, the yarn guide elements are pressed outwardly against the force of the spring element, so the yarn with the yarn thickening can also pass through the yarn sluice.

In a further embodiment also described in German Patent Publication DE 103 48 278 A1, the yarn guide elements of the yarn sluice are configured in such a way that one of the yarn guide elements is rotatably mounted in the manner of a revolver. In other words, by corresponding positioning of the rotatably mounted yarn guide element, the cross-section of the yarn guide channel can be adjusted. The configuration and arrangement of the yarn guide elements in this case allows a selection to be made between four different cross-sections of the yarn guide channel. In this embodiment as well, one of the yarn guide elements, preferably the rotatably mounted yarn guide element, is arranged in such a way that it can move aside when a yarn thickening occurs.

However, it is disadvantageous in the known yarn sluices that adaptation of the cross-section of the yarn guide channel to the respective thickness of the yarn is often relatively complex or an exact adaptation of the cross-section of the yarn guide channel to the respective yarn diameter is frequently not possible. In other words, in the first embodiment, in the event of a batch change, in which a change is made to a yarn with a different mean thickness, the yarn guide elements also generally have to be replaced, in other words, the installed yarn guide elements have to be replaced in a time-consuming manner by new yarn guide elements which fit the mean thickness of the new yarn.

In the second embodiment as well, in which a selection can be made by the rotatably mounted yarn guide element between four yarn guide channel sizes, difficulties can occur when the yarn has a mean thickness which does not correspond precisely to one of the adjustable yarn guide channel sizes. In other words, in a case such as this, problems are also often produced with regard to a proper sealing of the yarn treating chamber. It has moreover been shown that with the known yarn sluices, in particular with yarn sluices with a rotatably mounted yarn guide element, difficulties occasionally occur when yarn thickenings run through, because, for example, the mounting of the rotatably mounted yarn guide element cannot react sufficiently resiliently to yarn thickenings of this type. Difficulties of this type often result in damaging tensile force increases and problems in the sealing of the yarn guide channel.

SUMMARY OF THE INVENTION

Proceeding from the aforementioned prior art, the invention is based on the object of developing a yarn sluice, with which, under all operating conditions, in other words, regardless of the mean thickness of the yarn and the virtually inevitable yarn thickenings, a reliable sealing of a yarn treating chamber can always be ensured during the thermal setting of a yarn.

This object is addressed according to the invention by a yarn sluice for sealing a yarn treating chamber under excess pressure, in which a traveling yarn is thermally treated. The yarn sluice comprises in the region of a yarn inlet opening and a yarn outlet opening of the yarn treating chamber yarn guide elements forming a yarn guide channel which is sealed by the traveling yarn in the operating state. At least one of the yarn guide elements is positionable for adaptation to the mean thickness of the traveling yarn in various, predetermined positions. Means is provided which allows temporary adaptation of the yarn guide channel cross-section to yarn defects. According to the invention, at least one of the first and second yarn guide elements forming the yarn guide channel is steplessly adjustably mounted for adaption to the mean thickness of the yarn to be processed, and a sealing element, which can be placed on the first and the second yarn guide element, extends along the yarn guide channel for closing the yarn guide channel and for reacting resiliently to defects in the traveling yarn.

The configuration of the yarn sluice according to the invention has the advantage that because of the steplessly displaceably mounted first guide element, an exact adaptation of the width of the yarn guide channel to the mean thickness of the yarn to be processed is possible and it is also ensured by the resilient sealing element resting on the yarn guide elements that yarn thickenings can pass through the yarn sluice without causing a notable pressure loss in the yarn treating chamber under excess pressure. In other words, the sealing element resting on the yarn guide elements ensures, on the one hand, that the yarn guide channel is securely closed during operation over its entire length and, on the other hand, the sealing element reacts resiliently to defects in the traveling yarn immediately. By using the resilient sealing element, it is therefore ensured that yarn defects, such as, for example, neps or splices, when running through the yarn sluices, do not lead to a significant tensile force increase nor do sealing problems occur. The sealing element is, in each case, only resiliently deformed by a yarn defect in the region of the yarn defect and, in the process, slightly spaced apart from the yarn guide elements, which merely leads to very small, virtually insignificant pressure losses.

With a yarn sluice configured according to the invention, a secure sealing of the yarn treating chamber, which is under excess pressure, relative to the environment is therefore ensured in all operating states.

In an advantageous embodiment it is provided that the steplessly adjustably mounted first yarn guide element is connected to a drive, which can be activated in a defined manner and is in turn connected to a control and/or a regulating device. A configuration of this type does not only allow a sensitive, very precise positioning of the first yarn guide element and therefore a very precise adjustment of the width of the yarn guide channel to the mean thickness of the yarn, but also good reproducibility of the process, as the yarn guide element at each adjusting process can always be positioned in a precisely predeterminable position that is optimal for the process.

This good reproducibility of the adjustment can be easily realised, in particular when the drive of the yarn sluice is configured as a stepping motor and a sensor device, with which the zero position of the stepping motor can be controlled, is present in the region of the drive.

Stepping motors of this type, as is known, require only a relatively small control outlay with respect to the precise adjustment of their angle of rotation.

In an alternative embodiment, however, it is in principle also possible to manually position the steplessly adjustably mounted yarn guide element. A manual positioning of this type is in fact very economical, but poses the risk of incorrect adjustments occurring. Moreover, a manual positioning of the displaceably mounted yarn guide element is time-consuming.

The steplessly adjustably mounted first yarn element is configured, in an advantageous embodiment, as a yarn guide wedge, which is displaceably mounted in an also wedge-shaped recess of a sluice insert of the yarn sluice. The sluice insert, in this case, also forms the fixed second yarn guide element of a yarn guide channel. As the yarn guide wedge can only move along the oblique contact line of the wedge-shaped recess, it is ensured by a configuration and arrangement of this type that the yarn guide elements forming the yarn guide channel are always oriented parallel to one another, in other words, it is always ensured that the yarn guide channel, in each position of the yarn guide wedge, adopts a width which is the same over the entire length of the yarn guide channel.

The yarn sluice may have a sealing element, which is configured and arranged in such a way that the system pressure prevailing in the yarn sluice acts on the sealing element and keeps it abutting on the yarn guide elements during the yarn treating process.

This ensures that the sealing element over the entire yarn guide channel length is resiliently positioned on the yarn guide channel with a uniform contact pressure.

If necessary, in particular to thread and unthread a yarn into or from the steam setting device, the sealing element of the respective yarn sluice can be positioned without problems spaced apart from the yarn guide elements of the yarn guide channel of the yarn sluice in that an angle lever carrying the sealing element is pneumatically pivoted from its working position into a threading position located slightly spaced apart from the yarn guide elements.

The sealing element resting on the yarn guide elements, which is equipped with a flexible, low-wear sealing band made of a metallic material and has a resilient intermediate insert made of a temperature-resistant resilient material, for example, foam, rubber, silicone rubber or the like, and arranged below the sealing band, during the yarn treatment ensures, on the one hand, that the yarn guide channel is properly closed and, on the other hand, yarn thickenings, such as neps or splices, which are located in the traveling yarn, cannot lead to a tensile force increase, as the resilient intermediate layer of the sealing element when running through a yarn thickening of this type, automatically resiliently moves away in the region of the yarn thickening. In other words, even a yarn which has a yarn thickening can pass through the yarn sluice without problems. As the resilient moving away of the intermediate layer always only takes place in the direct region of the yarn thickening and the sealing band protecting the intermediate layer is held in a sealing manner on the yarn guide elements over the remaining yarn guide channel length by the intermediate layer, the pressure loss of the relevant yarn sluice caused by a yarn thickening is extremely small.

In a particularly advantageous embodiment, the sealing element is configured as a slotted strip, in the receiving slot of which is fixed an H-shaped, resilient intermediate insert, with play. The intermediate insert is also covered here by a flexible, wear-resistant sealing band and thus protected against wear by the traveling yarn. The configuration of the sealing element as a slotted strip, in conjunction with the configuration of the intermediate layer as an H-shaped component, leads to an easily assembleable and very flexible sealing unit, which ensures good sealing of the steam setting device both during regular operation and also during the occurrence of yarn thickenings and, in the process, also prevents tensile force increases occurring on the traveling yarn.

It may be provided that sensors, which monitor the physical variables prevailing in the interior of the yarn treating chamber, such as temperature and/or pressure, are additionally connected to the control and/or the regulating device of the yarn sluice, which inter alfa activates the drive, which can be activated in a defined manner for the steplessly adjustably mounted first yarn guide element. The control and/or the regulating device has a control loop, which by corresponding positioning of the steplessly adjustably mounted first yarn guide element ensures that during the yarn treading process, virtually constant conditions are always maintained in the yarn treating chamber. It is thus ensured that a steam setting device equipped with yarn sluices according to the invention always optimally treats the yarn running through and quality deviations are practically ruled out.

BRIEF DESCRIPTION OF THE DRAWINGS

Further details of the invention will be described below with the aid of embodiments shown in the figures, in which.

DETAILED DESCRIPTION OF THE PREFERRED EMBODIMENTS

Figure 1:
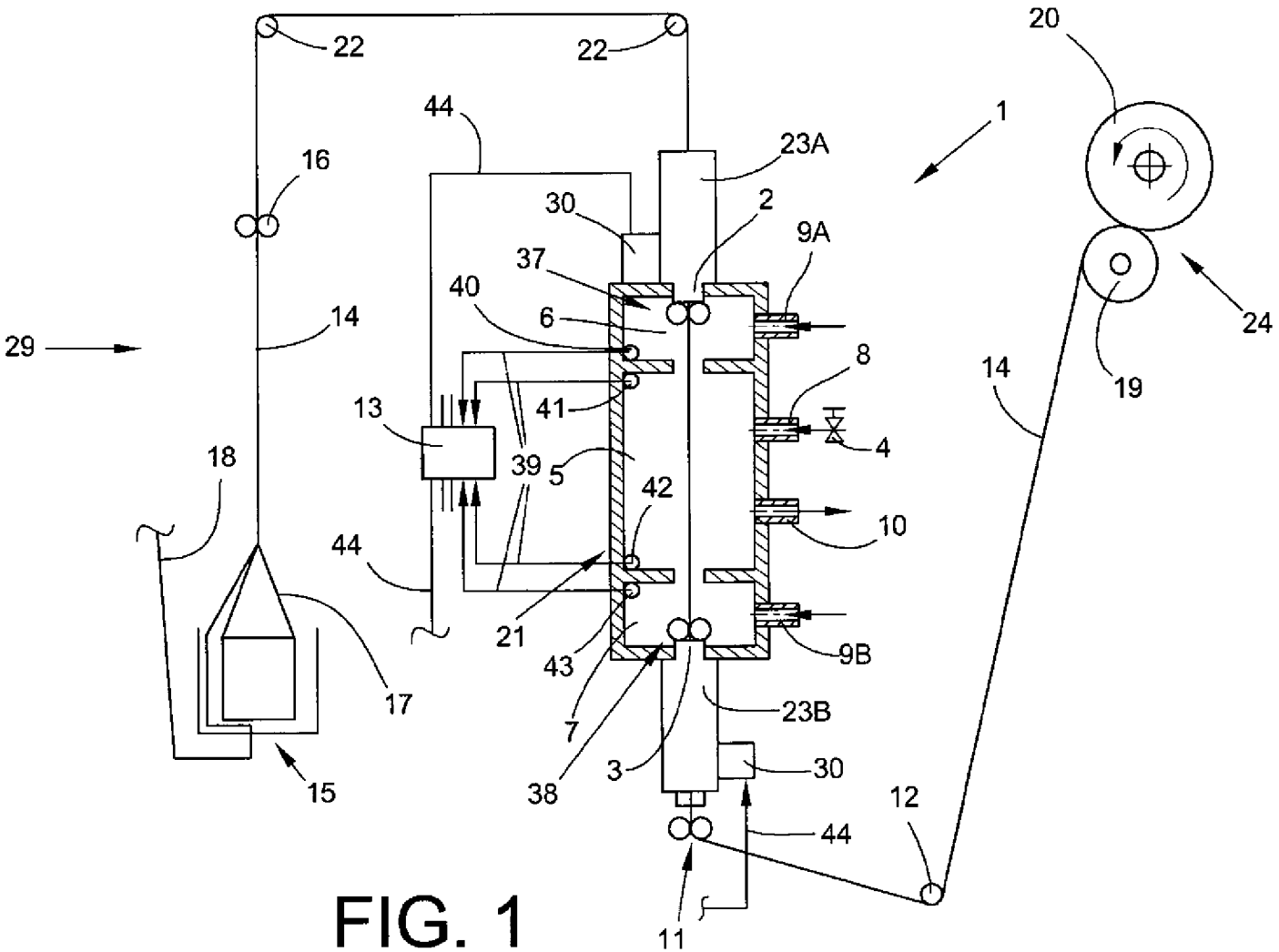
FIG. 1 shows a schematic diagram of a workstation of a twisting machine with a steam setting device, the yarn treating chamber of the steam setting device being sealed by yarn sluices according to the invention.

FIG. 1 sketches a schematic view of a workstation 29 of a twisting machine. Textile machines of this type generally have a large number of structurally identical workstations 29 of this type located next to one another. As shown, in the present embodiment, each of the workstations 29 has a steam setting device 1, which is used to thermally set the yarn 14 drawn off from a twisting device 15.

The workstations 29 also have a control and/or a regulating device 13, which is used to control or regulate the various work components of the workstation 29. As can be seen, a creel thread 18 is fed to a thread 17 drawn off from a twisting pot of the twisting device 15 and is twisted with the latter to form a yarn 14. The yarn 14 arrives via a draw-off device 16 and deflection means 22 at the steam setting device 1, in which, as already indicated above, the yarn 14 is thermally set.

The steam setting device 1, as conventional, substantially consists of a yarn treating chamber 21, which is in turn divided into a central zone 5 and two end zones 6 and 7. The central zone 5 is, in this case, supplied via a connection 8 with a hot, gaseous medium, preferably saturated steam or hot steam, while a cool gaseous medium, for example compressed air, is blown into the end zones 6 and 7, in each case via connections 9A or 9B.

The central zone 5 also has a connection 10, by means of which steam or condensate can be removed. The yarn treating chamber 21 furthermore has a yarn inlet opening 2 in the region of the end zone 6 and a yarn outlet opening 3 in the region of the end zone 7. Arranged in the yarn inlet opening 2 and the yarn outlet opening 3 is, in each case, a yarn sluice 23A or 23B, which seals the yarn treating chamber 21 under excess pressure relative to the environment.

The yarn 14 thermally set in the steam setting device 1 is guided by a draw-off device 11 and deflection means 12 to a winding device 24 of the workstation 29 and wound there to form a cross-wound bobbin 20. The cross-wound bobbin 20 is rotably held here in a pivotable creel (not shown) and rests on a winding roller 19, by means of which it is driven by frictional engagement and is made to rotate in order to wind on the yarn 14.

The hot gaseous medium is fed to the yarn treating chamber 21 of the steam setting device 1 by a steam line (not shown) of the twisting machine. The feeding of the steam may, in this case, be metered by a shut-off device 4 configured as a steam valve and be interrupted if necessary.

As also shown in FIG. 1, the steam setting device 1 is also equipped, in each case, with a supply mechanism 37 or a supply mechanism 38 in the region of the yarn inlet opening 2 and in the region of the yarn outlet opening 3, said supply mechanisms being used to feed the yarn 14 to be treated or to remove the treated yarn 14. For this purpose, the two supply mechanisms 37, 38 are driven in such a way that the yarn 14 running through the steam setting device 1 is held substantially constantly without tension between the supply mechanisms 37, 38.

The steam setting device 1 is furthermore equipped with a sensor device, the sensors 40, 41, 42, 43 of which are connected by signal lines 39 to the control and regulating device 13. The control and/or regulating device 13 is also connected by control lines 44 to the drives 30 of the yarn sluices 23A and 23B and by signal lines to sensor devices 31 (not shown in FIG. 1) installed in the region of the drives 30.

Figure 2:
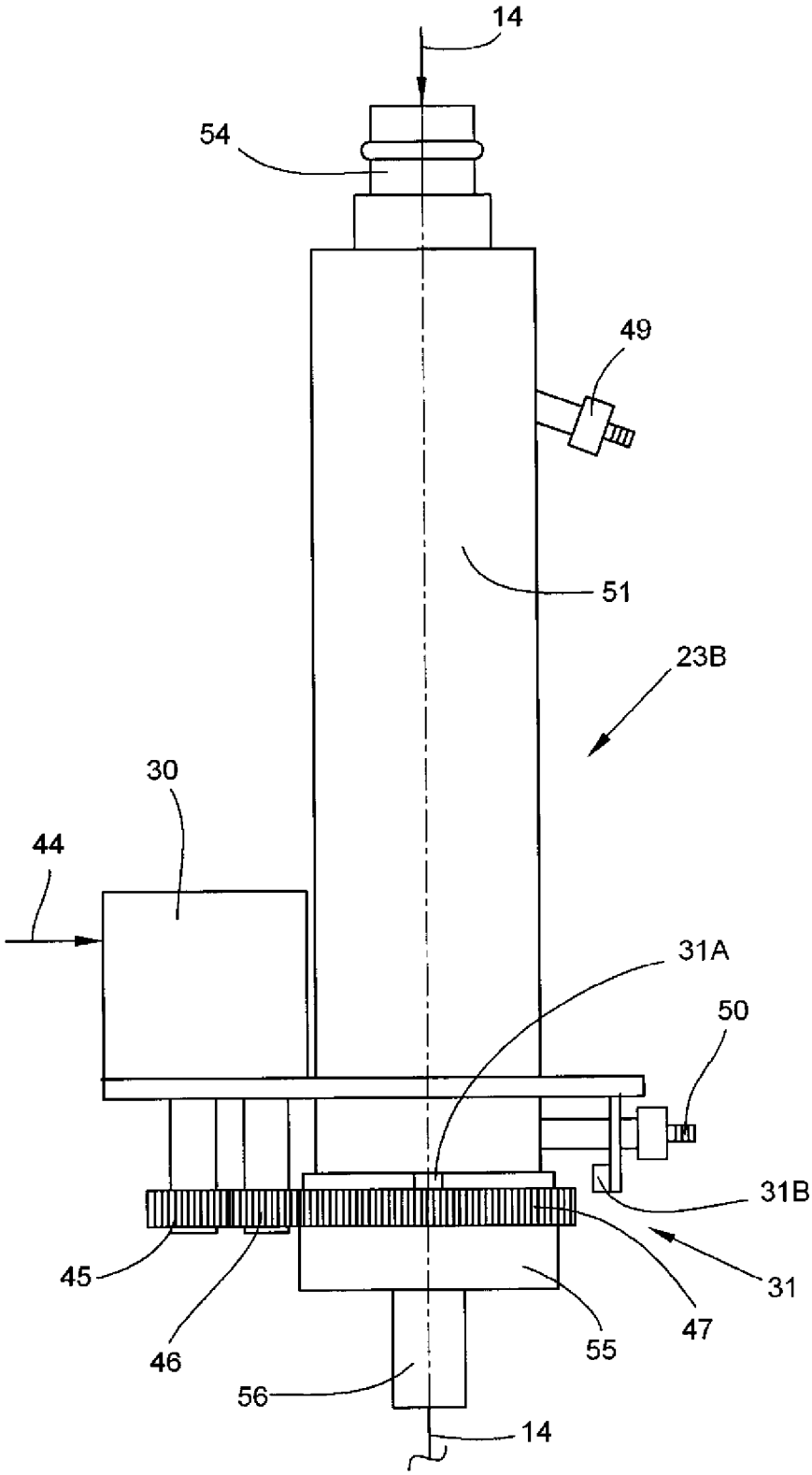
FIG. 2 shows the electric motor drive and a part of an associated reducing gear of a yarn sluice.

FIG. 2 shows one of the yarn sluices 23A, 23B, in the embodiment, the yarn sluice 23B located downstream in the yarn running direction, the superstructure of which, as can be seen, is surrounded by a housing 51. The yarn sluice 23B, on the inlet side, has a connection piece 54, with which it is fixed in the yarn outlet opening 3 of the yarn treating chamber 21 and, on the output side, has an injector device 56, which can be loaded with compressed air via a connection 50 and allows a pneumatic threading of the yarn 14 through the entire steam setting device 1. In other words, an airflow, which allows the yarn transportation within the steam setting device 1, can be initiated within the steam setting device 1 via the compressed air connection 50.

By means of a compressed air connection 49, the yarn sluice 23B can also be loaded with a system pressure which, as will be explained below, acts on a sealing element 28 and ensures that the sealing element 28 is properly positioned on the yarn guide channel 25 of the yarn sluice 23B during the yarn treating process.

A pneumatic cylinder, which ensures during loading that the sealing element 28 during the threading of a yarn 14 can be raised from the yarn guide channel 25, is simultaneously connected to the compressed air connection 50.

Figure 4:
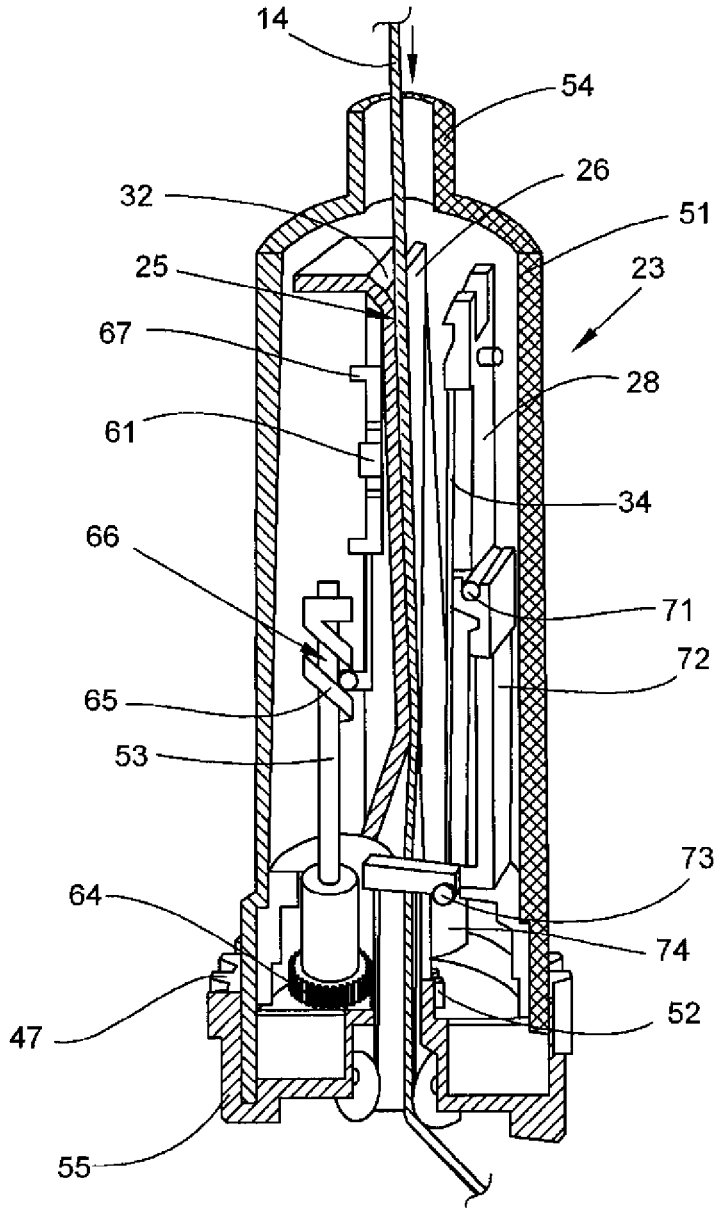
FIG. 4 shows a side view, partially in section, of a yarn sluice according to the invention.

As can also be seen from FIG. 2, the yarn sluice 23B also has an electric motor drive 30, preferably a stepping motor, which is connected by a gear arrangement and a link guide (not shown in FIG. 2) to the steplessly adjustable first yarn guide element 26 of the yarn sluice 23B. In other words a pinion 45 fastened to the motor shaft of the stepping motor 30 meshes with an intermediate toothed wheel 46, which in turn drives a relatively large external toothed wheel 47. The external toothed wheel 47, as can be seen in particular from FIG. 4, is a component of a sleeve-like structural component of the yarn sluice 23B, this structural component 55 furthermore having a small, coaxially arranged pinion 52, which meshes with the pinion 64 of a link spindle 53. Also arranged in the region of the external toothed wheel 47 is a sensor device 31 which preferably consists of a permanent magnet insert 31A and a Hall element 31B and monitors the zero position of the drive 30 configured as a stepping motor. The drive 30 is connected by a control line 44 to the control and/or regulating device 13.

Figure 3A:
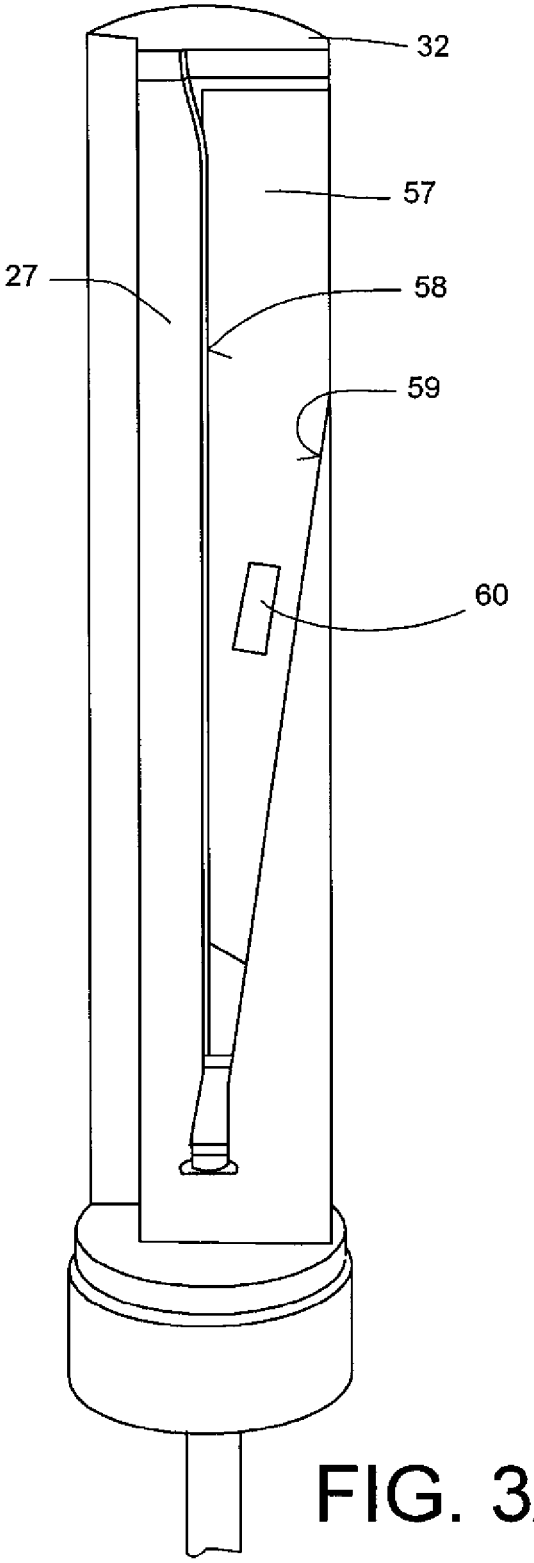
FIG. 3A shows a front view of a sluice insert of a yarn sluice with a recess for receiving a displaceably mounted yarn guide element.
Figure 3B:
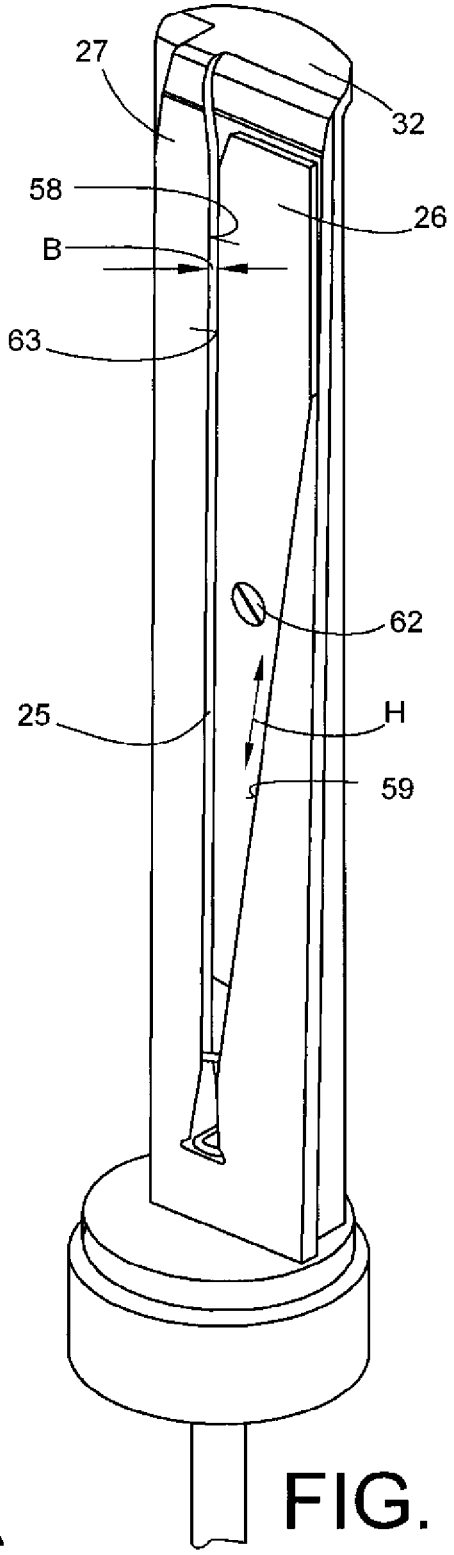
FIG. 3B shows a perspective view of the sluice insert according to FIG. 3A with a steplessly displaceably mounted first yarn guide element arranged in the recess.

FIGS. 3A and 3B show, in a front view or in a perspective view, a sluice insert 32 arranged within a yarn sluice 23, FIG. 3A showing the sluice insert 32 without the installed, steplessly adjustably mounted first yarn guide element 26 and FIG. 3B showing the sluice insert 32 with said yarn guide element 26.

Figure 5:
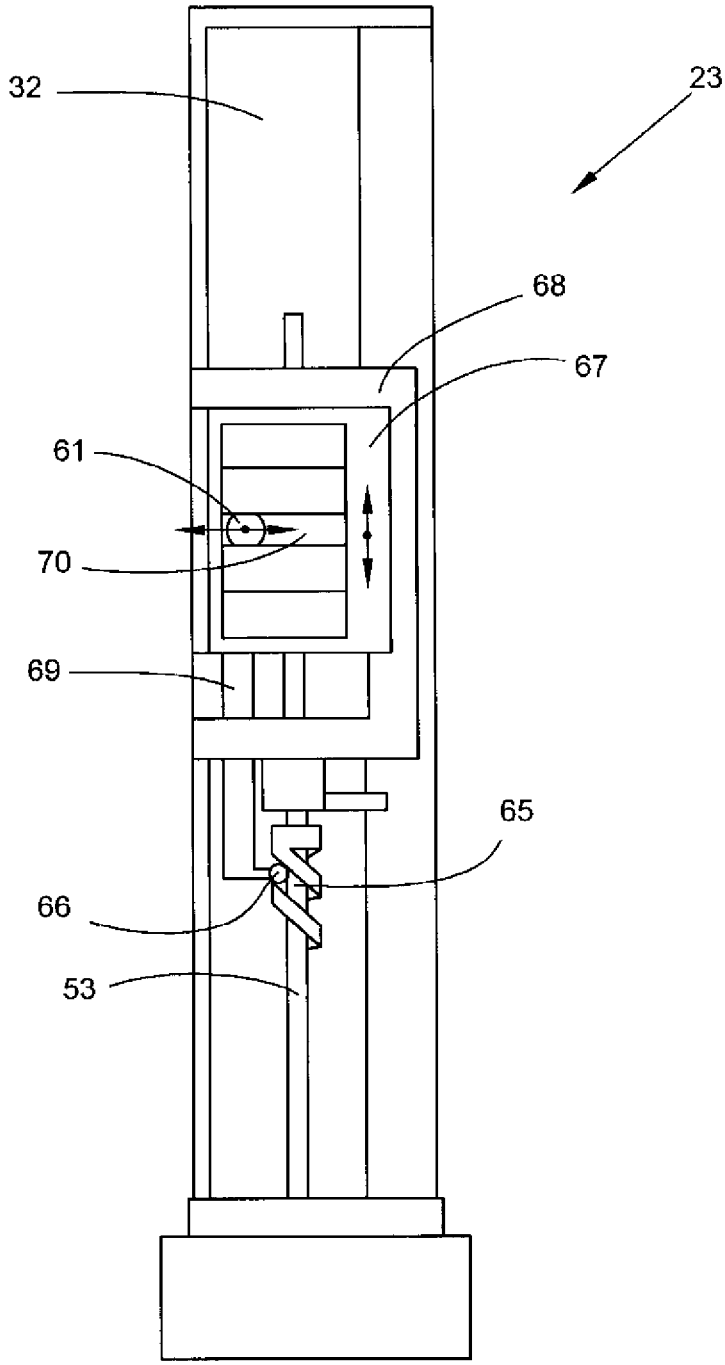
FIG. 5 shows a rear view of the sluice insert of a yarn sluice with a gear arrangement for converting the rotational movement of the electric motor drive into a translatory movement to displace the steplessly displaceably mounted first yarn guide element.

As can be seen from FIG. 3A, the sluice insert 32, on its front side, is configured as a plate-like component, into which a wedge-shaped recess 57 is worked. The plate-like component of the sluice insert 32, during operation, in this case forms, with its side face 58 pointing to the recess 57, a fixed second yarn guide element 27 of a yarn guide channel 25. The opposing side face 59 arranged in a wedge shape of the sluice insert 32 forms a guide for the steplessly adjustably mounted first yarn guide element 26, not shown in FIG. 3B, of the yarn sluice 23. As can be seen from 3A, the rear of the recess 57 also has a groove 60, which is arranged parallel to the side face 59 of the recess 57 and in which a connector 61, as is described in more detail below with the aid of FIG. 5, is guided.

As shown in FIG. 3B, the displaceably mounted first yarn guide element 26 is connected by means of a screw bolt 62 to the connector 61 and is guided by the connector 61 in the groove 60 of the sluice insert 32. The outside 63 of the displaceably mounted first yarn guide element 27 facing the side face 58 of the fixed second yarn guide element 27, in conjunction with the side face 58, forms a yarn guide channel 25. By corresponding positioning, indicated by the arrow H, of the displaceable first yarn guide element 26, the width B of the yarn guide channel 25 can be steplessly adjusted.

The rear of the yarn guide channel 25 is formed by the rear wall of the recess 57 of the sluice insert 32, while a sealing element 28 acts as the front wall of the yarn guide channel 25, said sealing element resting resiliently on the yarn guide elements 26, 27 during operation and it being possible to raise it pneumatically from the yarn guide channel 25 to thread in a new twisted yarn 14.

FIG. 4 shows a side view, partially in section, of a yarn sluice 23 which, as already indicated above in conjunction with FIG. 2, has a sleeve-like structural component 55 with an external toothed wheel 47 and a small, coaxially arranged pinion 52, which meshes with the pinion 64 of a link spindle 53. The link spindle 53 has a link guide 65, to which is connected, by means of a ball head 66, a guide slide 67 which, as can be seen in particular from FIG. 5, is vertically displaceably mounted in the region of the rear of the sluice insert 32 and is secured here by a guide plate 68.

It can clearly be seen here from FIG. 5, showing a rear view of the yarn sluice 23, how the guide slide 67 is connected by a ball head 66, which is mounted at the end of a connection lever 67, to the link guide 65 of the link spindle 53. The guide slide 67 in turn has a slide link 70, in which the connector 61, to which the displaceably mounted first yarn guide element 26 is connected, is horizontally displaceably guided. The connector 61 engages, as already indicated above, through the groove 60, which is worked into the base of the recess 57 parallel to the side face 59 running in a wedge shape, of the recess 57 of the sluice insert 32.

Also arranged in the region of the connector 61 is a flexible support disc (not shown), which, in connection with a corresponding sealing film, ensures sealing, in other words, the sealing film prevents the system pressure of the yarn sluice 23 prevailing in the region of the yarn guide elements 26, 27 and the sealing element 28 from being able to be reduced via the groove 60.

Figure 6:
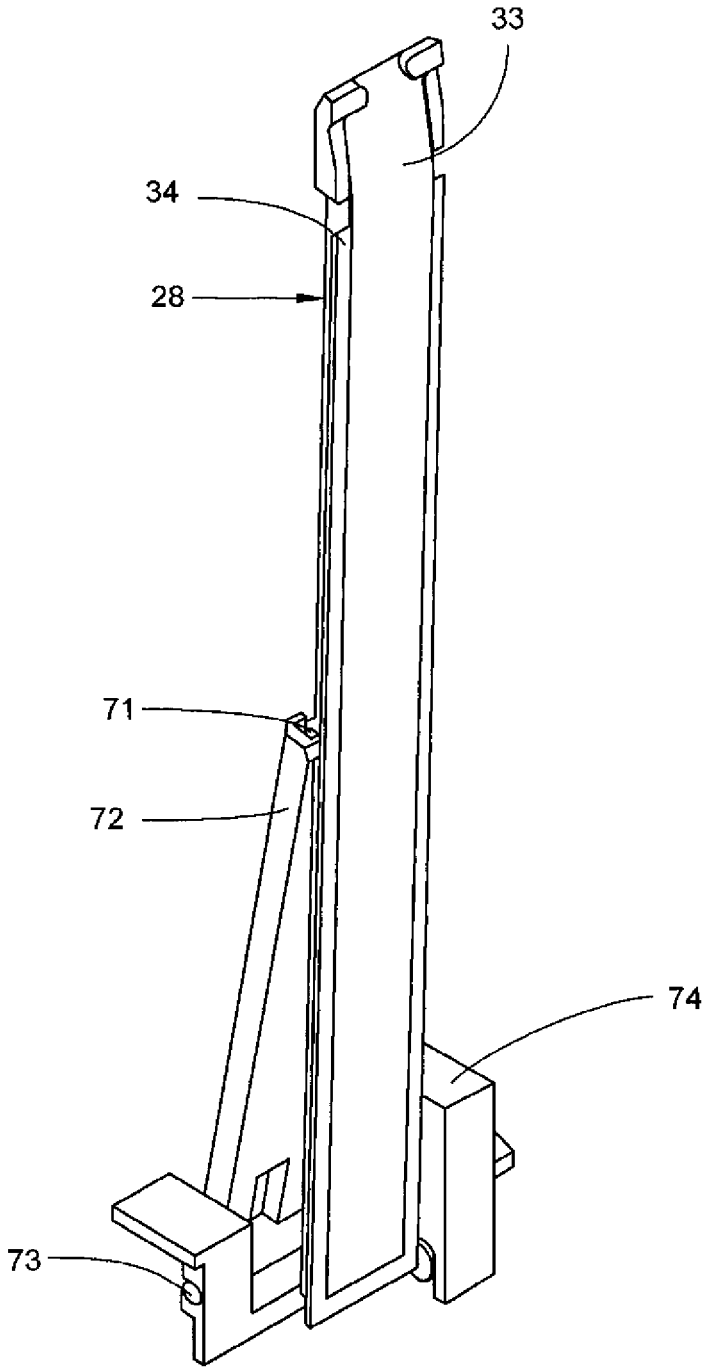
FIG. 6 shows a first embodiment of a sealing element.
Figure 7:
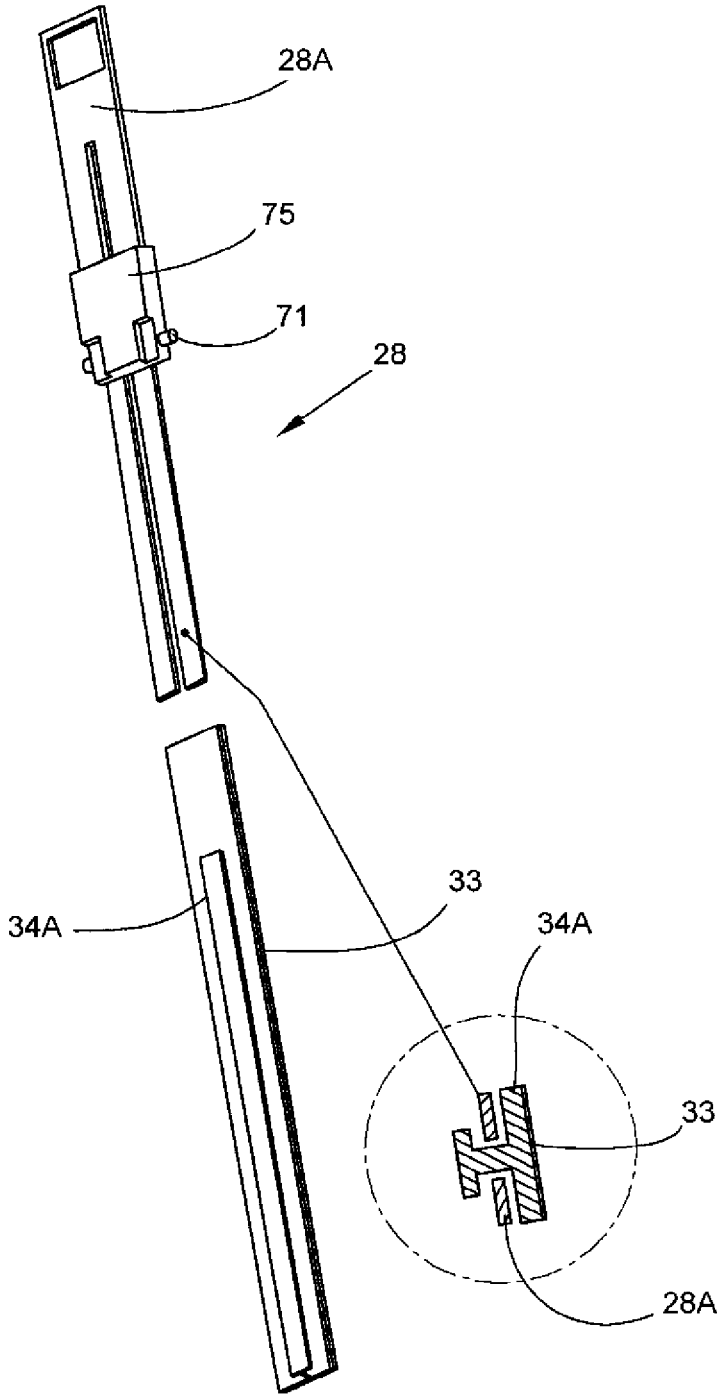
FIG. 7 shows a further, preferred embodiment of a sealing element.

Two embodiments are shown in FIGS. 6 and 7 for a sealing element 28, which in each case forms the fourth, resilient limiting wall of the yarn guide channel 25 of the yarn sluice 23A or 23B.

According to the embodiment of FIG. 6, the sealing element 28 has a resilient intermediate layer 34, which is fastened to the sealing element 28, and a thin, planar, wear-resistant sealing band 33, which covers the intermediate layer 34. The intermediate layer 34 is in this case preferably produced from a temperature-resistant, resilient material, for example foam or the like, while the sealing band 33 is produced from a metal or another abrasion-resistant material. In the embodiment according to FIG. 6, the sealing band 33 is mounted at the top in the sealing element 28 and non-positively positioned on the intermediate layer 34, for example by permanent magnet inserts (not shown), which are arranged in corresponding receivers of the sealing element 28. As shown, for example, in FIG. 4, the sealing element 28 is movably mounted to a limited extent within the yarn sluice 23 by means of a pivot pin 71 on an angle lever 72, which is in turn connected by a pivot pin 73 to a holder 74. Arranged within the holder 74 is a spring element (not shown) which loads the angle lever 72 by means of a short lever arm in such a way that the angle lever 72 is pivoted in the direction of the yarn guide channel 25 and the sealing element 28 is thereby positioned on the yarn guide channel 25, where the sealing element 28 is also loaded with the system pressure of the yarn sluice 23.

The lever arm of the angle lever 72 can, however, also be loaded by a small pneumatic cylinder against the force of the spring element. The pneumatic cylinder then ensures that the sealing element 28 is raised from the yarn guide channel 25, which considerably facilitates the threading in of a new twisted yarn.

FIG. 7 shows a further preferred embodiment of a sealing element 28. As shown in the upper half of FIG. 7, the sealing element 28 is configured here as a slotted strip 28A. The intermediate layer 34A formed in an H-shape and shown in the lower half of FIG. 7 can be threaded into the slot of the strip 28A and is fitted with a relatively large amount of play. The intermediate layer 34A is in turn covered with a metallic sealing band 33 and thereby protected against abrasion by the traveling yarn 14.

The sealing element according to FIG. 7, as described above in connection with FIG. 6, is also movably mounted to a limited extent on an angle lever 72 and, for this reason, has a bearing device 75, which has a corresponding pivot pin 71.

Functioning of the yarn sluice according to the invention:

Before the beginning of the thermal treatment process of a yarn 14 provided by the twisting device 15 in the steam setting device 1, the latter firstly has to be put into its operating state, in other words, the steam setting device 1 has to be heated. Moreover, the width B of the yarn guide channel 25 of the yarn sluices 23A and 23B has to be adjusted in accordance with the mean thickness of the yarn 14 to be processed.

The control and/or regulating device 13, for this purpose, activates the stepping motors 30 of the yarn sluices 23A and 23B in such a way that the adjustably mounted first yarn guide elements 26 of the yarn sluices are positioned in an optimal position for the mean thickness of the yarn to be treated. Furthermore, by actuating corresponding pneumatic cylinders present in the yarn sluices, the sealing elements 28 of the yarn sluices 23A and 23B are raised from the associated yarn guide channels 25.

An injector device 56 is then loaded with compressed air at the yarn sluice 23B located downstream in the yarn running direction, the yarn 14 is pneumatically threaded through the two yarn sluices 23A and 23B and the yarn treating chamber 21 located in between and transferred to the winding device 24.

In the next step, the yarn sluices 23A and 235 are loaded via the connections 49 with a system pressure and simultaneously the pneumatic cylinders at the angle levers 72 of the sealing elements 28 are switched to be without pressure, with the result that the sealing elements 28 are resiliently placed on the yarn guide elements 26, 27 and therefore form yarn guide channels 25, the cross-section of which is optimally adapted to the mean thickness of the yarn 14 to be treated. In other words, the yarn 14 located in the yarn guide channels 25 prevents, for example, hot steam being able to leave the yarn treating chamber 21 and go into the environment via the yarn guide channels 25 of the yarn sluices 23A and 23B. This optimal sealing by the yarn sluices 23A and 235 is also provided when the workstation is then started and a traveling yarn 14 is then thermally treated in the steam setting device 1.

The seal is obviously also maintained when the traveling yarn 14 has a yarn thickening, for example in the form of a nep or a splice and this yarn thickening runs through one of the yarn sluices 23A or 235. In a case such as this, the resilient intermediate layer 34 of the sealing element 28 resting on the yarn guide channel 25 is pressed back slightly by the yarn thickening, so the yarn thickening, without problems, in other words without a significant increase in tensile force, can run through the relevant yarn sluice 23. As the sealing band 33 of the sealing element 28 protecting the intermediate layer 34 is in each case only loaded in the direct region of the yarn thickening, a reliable seal continues to be provided in the remaining regions of the yarn guide channel 25 not affected by the yarn thickening, in other words before and after the yarn thickening, so the pressure loss when a yarn thickening runs through is minimal. The yarn treating chamber 21 is consequently always reliably sealed relative to the environment under all conditions.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Yarn sluice for sealing a pressurized yarn treating chamber in which a traveling yarn is thermally treated, the yarn sluice comprising:

yarn guides in the region of a yarn inlet opening and a yarn outlet opening of the yarn treating chamber, each yarn guide including first and second yarn guide elements (26, 27) forming a yarn guide channel (25) which is sealed by the traveling yarn in the operating state, at least one of the yarn guide elements of each yarn guide being positionable for adaptation to the mean thickness of the traveling yarn in various predetermined positions, each yarn guide having means which allows temporary adaptation of a cross-section of the yarn guide channel to yarn defects, at least one of the first and second yarn guide elements (26, 27) of each yarn guide forming the yarn guide channel (25) being steplessly adjustably mounted for adaption to the mean thickness of the traveling yarn (14), and each yarn guide having a sealing element (28), which can be placed on the first and the second yarn guide element (26, 27), extending along the yarn guide channel (25) for closing the yarn guide channel (25) and for reacting resiliently to defects in the traveling yarn (14).

2. Yarn sluice according to claim 1, characterised in that the steplessly adjustably mounted yarn guide element (26) is connected to a drive (30), which can be activated in a defined manner and is in turn connected to a control and/or a regulating device (13).

3. Yarn sluice according to claim 2, characterised in that the drive (30) is configured as a stepping motor and further comprising a sensor device (31) to monitor the zero position of the stepping motor.

4. Yarn sluice according to claim 1, characterised in that the steplessly adjustably mounted yarn guide element (26) can be positioned manually.

5. Yarn sluice according to claim 1, characterised in that the first yarn guide element (26) is configured as a yarn guide wedge, which is displaceably mounted in a wedge-shaped recess (57) of a sluice insert (32) of the yarn sluice (23), the sluice insert forming a fixed second yarn guide element (27) of the yarn guide channel (25).

6. Yarn sluice according to claim 1, characterised in that the sealing element (28) is configured and arranged in such a way that the system pressure prevailing during the yarn treating process in the yarn sluice (23) acts on the sealing element (28) and keeps it abutting on the yarn guide elements (26, 27).

7. Yarn sluice according to claim 1, characterised in that the sealing element (28) comprises means for threading and unthreading a yarn (14) into and from a steam setting device (1) spaced apart from the yarn guide elements (26, 27) of the yarn guide channel (25) of the yarn sluice (23).

8. Yarn sluice according to claim 1, characterised in that the sealing element (28) resting on the yarn guide elements (26, 27) is equipped with a flexible, low-wear sealing band (33) made of a metallic material and has a resilient intermediate insert (34) made of a temperature-resistant resilient material and arranged below the sealing band (33).

9. Yarn sluice according to claim 1, characterised in that the sealing element (28) is configured as a slotted strip (28A), in which an H-shaped, resilient intermediate insert (34A) is fixed, the intermediate insert (34A) being covered by a flexible, low-wear sealing band (33).

10. Yarn sluice according to claim 2, characterised in that sensors (40, 41, 42, 43), which monitor the physical variables prevailing in the interior of the yarn treating chamber (21), are connected to the control and/or to the regulating device (13) for the drive (30) of the steplessly adjustably mounted yarn guide element (26), and in that the control and/or the regulating device (13) has a control loop, which ensures, by corresponding positioning of the yarn guide element (26), that virtually constant conditions are always provided during the yarn treating process in the yarn treating chamber (21).

* * * * *